US008800182B2

(12) United States Patent
Hung

(10) Patent No.: US 8,800,182 B2
(45) Date of Patent: Aug. 12, 2014

(54) PLASTIC FILM WITH CONCEALED TEARABLE STRIP

(71) Applicant: Tzu-Chin Hung, New Taipei (TW)

(72) Inventor: Tzu-Chin Hung, New Taipei (TW)

( * ) Notice: Subject to any disclaimer, the term of this patent is extended or adjusted under 35 U.S.C. 154(b) by 0 days.

(21) Appl. No.: 13/726,292

(22) Filed: Dec. 24, 2012

(65) Prior Publication Data

US 2014/0173954 A1 Jun. 26, 2014

(51) Int. Cl.

| | |
|---|---|
| ***G09F 1/04*** | (2006.01) |
| ***G09F 3/04*** | (2006.01) |
| ***G09F 23/00*** | (2006.01) |
| ***B65D 23/14*** | (2006.01) |
| *G09G 1/04* | (2006.01) |

(52) U.S. Cl.
CPC . *G09F 3/04* (2013.01); *G09F 23/00* (2013.01); *G09G 1/04* (2013.01); *B65D 23/14* (2013.01)
USPC ..... 40/310; 40/306; 40/674; 40/630; 283/105; 283/81; 281/2; 281/5; 428/43

(58) Field of Classification Search
CPC ..... G09F 3/04
USPC ..... 40/674, 310, 306, 630; 283/81, 105; 281/2, 5; 428/43
See application file for complete search history.

(56) References Cited

U.S. PATENT DOCUMENTS

| | | | | |
|---|---|---|---|---|
| 6,413,345 | B1 * | 7/2002 | Treleaven | 156/227 |
| 6,722,495 | B2 * | 4/2004 | Fresnel | 206/232 |
| 2004/0244242 | A1 * | 12/2004 | Maliner et al. | 40/310 |

FOREIGN PATENT DOCUMENTS

| | | |
|---|---|---|
| TW | 244980 I | 12/2005 |
| TW | 340926 M | 9/2008 |

* cited by examiner

*Primary Examiner* — Syed A Islam
(74) *Attorney, Agent, or Firm* — Rosenberg, Klein & Lee

(57) ABSTRACT

Disclosed is a plastic film with concealed tearable strip, which includes a film body; at least one first tearable strip having two sides respectively forming first and second joint sections; and at least one second tearable strip having two sides respectively forming a third joint section and an internal tear line. The first and second tearable strips each have one side connected to the film body. The first joint section has two sides each forming a tear line. The third joint section has one side forming at least one tear line. The third joint section and the internal tear line have inside faces respectively coupled to the first and second joint sections, whereby the first and second tearable strips are respectively located at outside and inside of the film body and the second tearable strip is concealed at the inside of the film body.

6 Claims, 13 Drawing Sheets

PLASTIC FILM WITH CONCEALED TEARABLE STRIP

BACKGROUND OF THE INVENTION

1. Field of the Invention

The present invention relates to a plastic film with concealed tearable strip, and in particular to a plastic film structure that is applicable to product wrapping film and comprises at least one tearable strip concealed inside an inner surface of the plastic film to provide qualification for participating in price awarding or activities.

2. The Related Arts

Packaging plastic films have been widely used in external packages of various containers of bottled and canned beverages and drinks. Particularly, tear lines are often provided at the portion of plastic film that corresponds to an openable part of the bottle/can, such as a bottle cap or can cover in order to enable a user to tear apart the plastic film along the tear lines for removing the cap or cover. Product manufacturers sometimes use the torn piece of plastic film as a proof for giveaways, bonus points, and discount coupons in order to intensify consumers' desire of purchasing the product and also increase the sales of the product.

However, in the conventional packaging plastic films, the tearable tabs or strips for giveaways, bonus points, and coupons are often directly attached to an outside surface of the packaging film without any concealing or security means. Consequently, the contents of the prizes to be awarded, the bonus points, and the discounts can be easily peeped. Sales retailers or consumers may substitute or hide particular products that carry high prizes, big bonus, or large discounts due to peeping out the contents of the tearable tabs or strips. In addition, the tearable strips of the plastic film may get easy broken or damaged during the process of transportation or handling due to being exposed on the outside surface of the plastic packaging film. Such damages of the tearable strips may result in disputes in respect of breaking and loss of the tearable strips that carry prizes, bonus points, or discount coupons. This is an issue to be immediately handled in the industry.

Making printings on both surfaces of a plastic packaging film or providing confidentiality or anti-fouling measure in the plastic packaging film may need to use complicated and expense means of ink printing, specific composite material, and plastic film coating process. This will lead to a significant increase of packaging cost, making it not economic.

Further, prior art references are known, such as Taiwan Utility Model No. M340926 and Invention No. I244980, which disclose, in a conventional plastic packaging film, application of complicated ink printing and special coating and plastic film combining process. These known solutions still suffer the same problems of complicated packaging process and increased packaging cost and are thus not economic. Further, these known solutions provide prize-awarding tearable strips that are exposed outside the packaged product and may get damaged during the transportation or being broken on purpose. These lead to exposure of the prizes or contents provided in the tearable strips and may result in unnecessary disputes.

SUMMARY OF THE INVENTION

The known plastic packaging films or the plastic packaging films disclosed in the prior art references all provide tearable strips that carry the information or proof of prize awarding, bonus points, and/or discount coupons that are arranged on an outside surface of the plastic film, whereby besides being less confidential and hard to keep secret, the strips may be easily damaged due to impact during transportation or being broken on purposes, leading to consumer's complaint or the strips must be protected through using complicated and expense processes of ink printing, special composite material, or film coating. This makes the packaging cost high.

Thus, the present invention provides a plastic film with concealed tearable strip, which comprises a film body; at least one first tearable strip, which has two sides respectively forming a first joint section and a second joint section; and at least one second tearable strip, which has two sides respectively forming a third joint section and an internal tear line, wherein the first and second tearable strips each have one side connected to each of opposite sides of the film body. The first joint section of the first tearable strip has two sides each forming a tear line. The third joint section of the second tearable strip has one side forming at least one tear line. The third joint section and the internal tear line have inside faces respectively coupled to the first and second joint sections of the first tearable strip, whereby the first tearable strip and the second tearable strip are respectively located at outside and inside of the film body and the second tearable strip is concealed at the inside of the film body. It is necessary to tear off the first tearable strip by tearing the tear lines of the first joint section of the first tearable strip so as to expose the second tearable strip. Then, the second tearable strip is torn off by tearing along the tear line and the internal tear line of the third joint section of the second tearable strip.

The effectiveness of the plastic film with concealed tearable strip according to the present invention couples a first joint section and a second joint section of the first tearable strip to inside faces of the third joint section and the internal tear line of the second tearable strip so as to form connection between the first tearable strip and the second tearable strip, which are thus respectively set at outside and inside of the film body, whereby the first tearable strip located on the outside of the film body must be first removed to allow the second tearable strip to be seen and torn off. The second tearable strip may comprise information regarding prize awarding, bonus points, and/or discount coupons printed thereon, which are thus concealed at the inside of the film body, whereby the information regarding prize awarding, bonus points, and/or discount coupons can only be accessed by performing two tearing operation of the first tearable strip and the second tearable strip and the prize, the bonus points, and/or the discount coupons of the product packaged by the film body are fully protected and kept confidential and concealed without applying complicated and expensive processes of ink printing, special composite material, and film coating. Thus, the plastic film packaging process that includes prize awarding, bonus points, and/or discount coupons can be significantly simplified and the packaging cost of the product can be lowered down.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
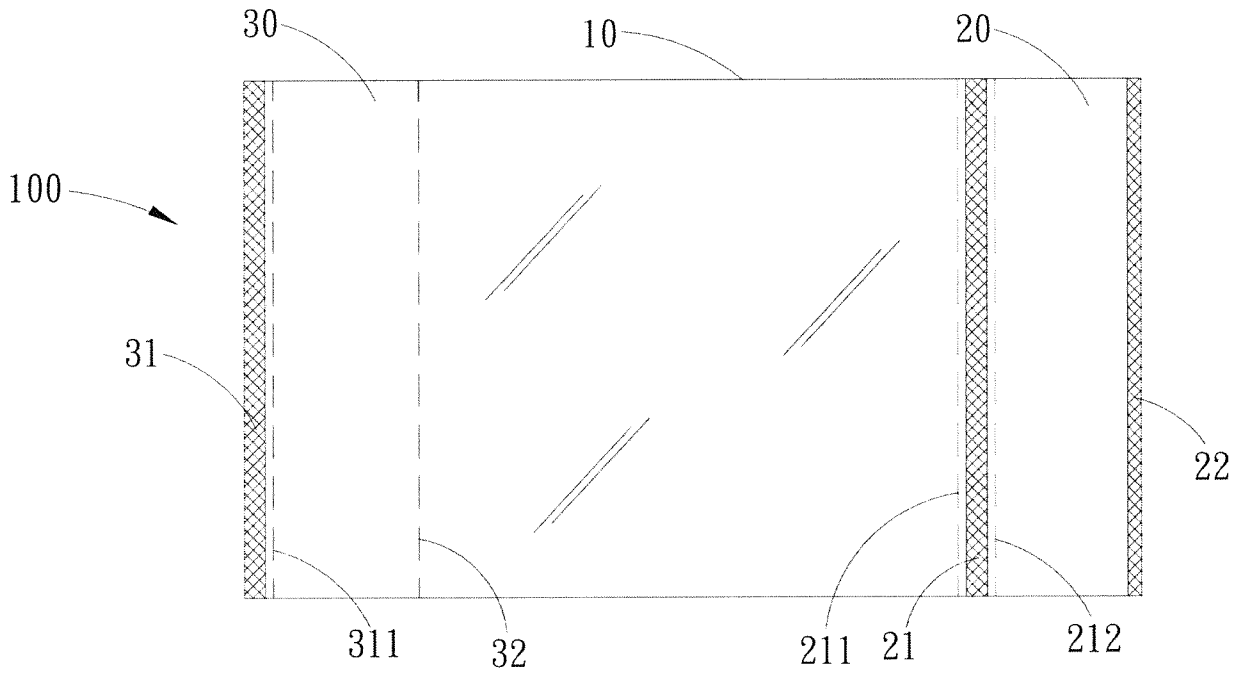
FIG. 1 is a developed view of a plastic film with concealed tearable strip according to a first embodiment of the present invention.
Figure 2:
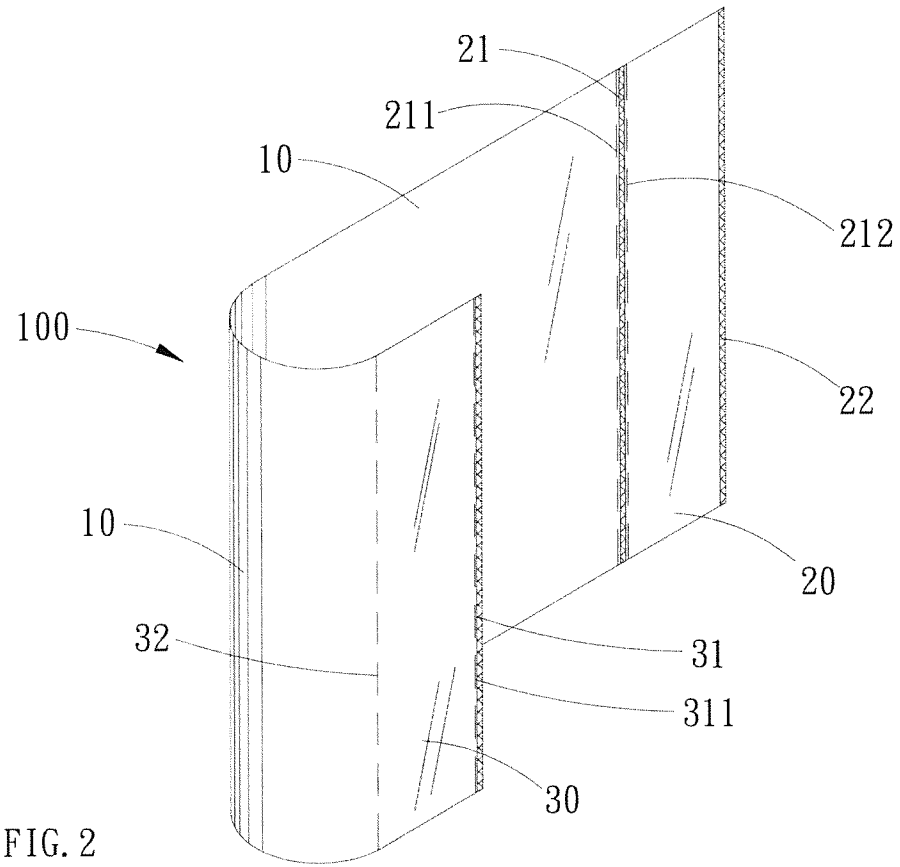
FIG. 2 is a perspective view of FIG. 1 in the developed form.
Figure 3:
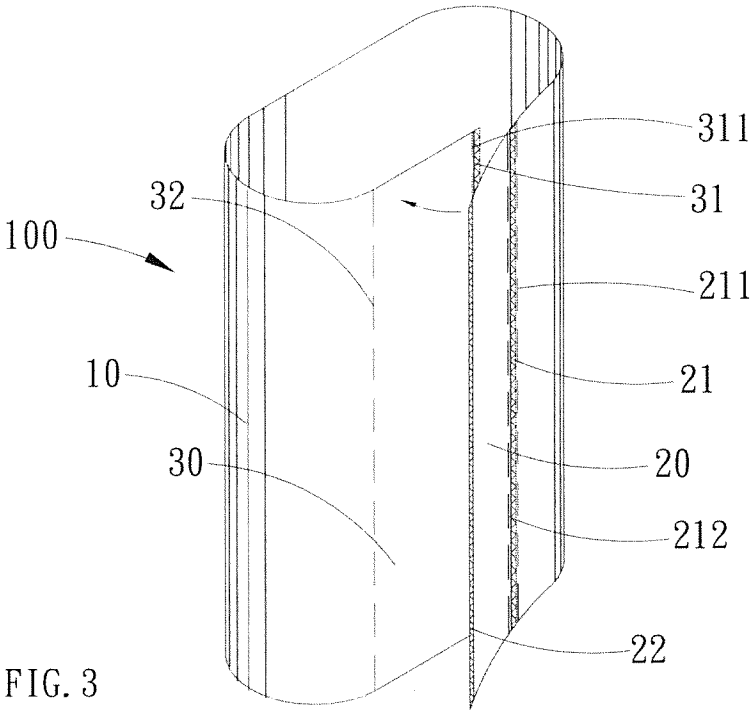
FIG. 3 is a perspective view showing first and second joint sections of a first tearable strip according to the present invention are being coupled to inside faces of a third joint section and an internal tear line of a second tearable strip.
Figure 4:
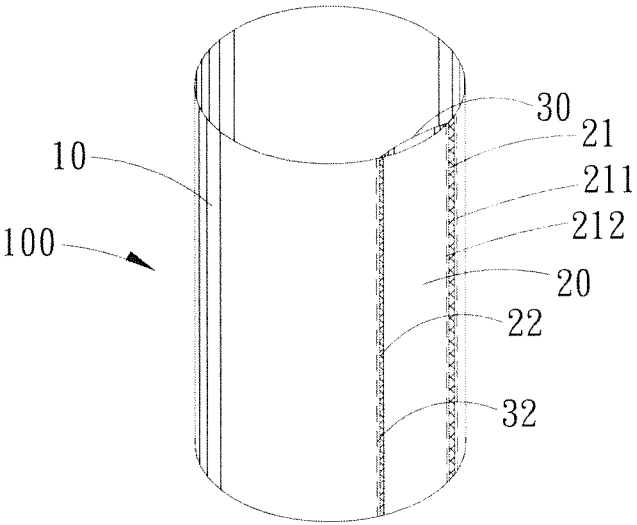
FIG. 4 is a perspective view showing the plastic film with concealed tearable strip according to the first embodiment of the present invention.
Figure 5:
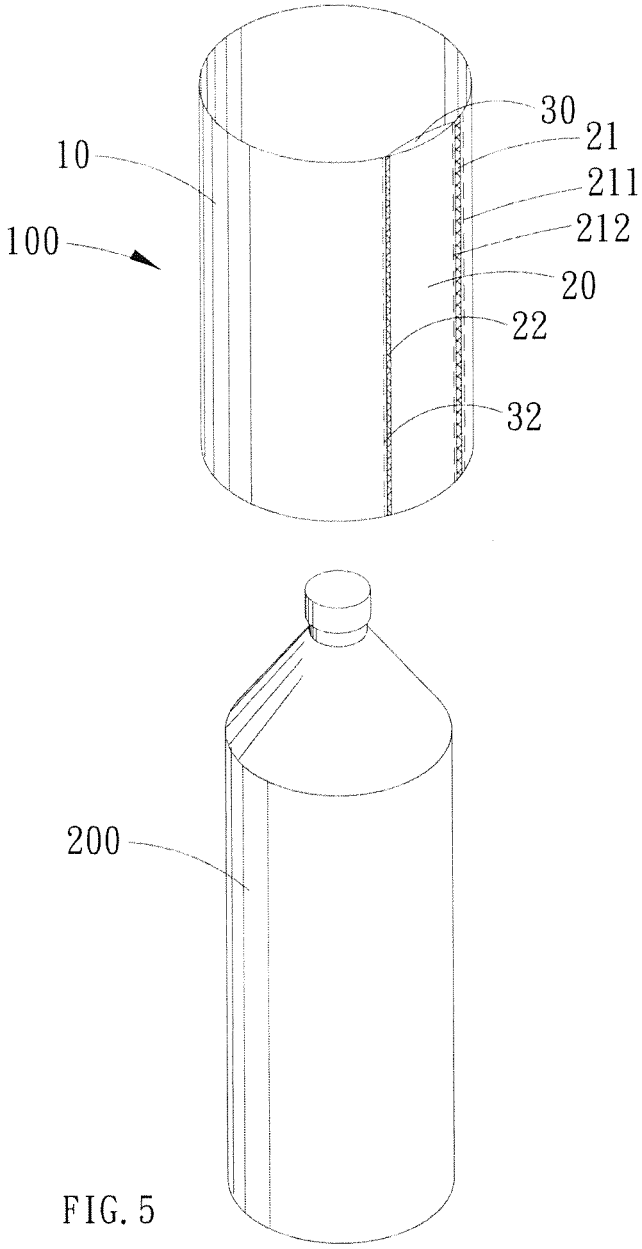
FIG. 5 is a perspective view showing an application of the plastic film with concealed tearable strip according to the present invention that is fit over a container.

With reference to the drawings and in particular to FIGS. 1-4, a plastic film with concealed tearable strip, generally designated at 100, is provided according to a first embodiment of the present invention. The plastic film 100 comprises a film body 10, which is not limited to any specific form, a heat shrinkage film that comprises product marking or advertisement pattern printed on either one or both of front and rear surfaces being taken as an example herein; at least one first tearable strip 20, which has an outside surface comprising information, patterns, or markings of product and advertisement printed thereon and two sides respectively forming at least one first joint section 21 and one second joint section 22. The first joint section 21 has two sides each forming a tear line 211, 212. The side of the first joint section 21 that forms the tear line 211 is connected to one of the sides of the film body 10. The connection between the first joint section 21 and the film body 10 is not limited to any specific form or way and in the first embodiment of the present invention, an example that the first joint section 21 is integrally formed with the film body 10 is illustrated.

Figure 9:
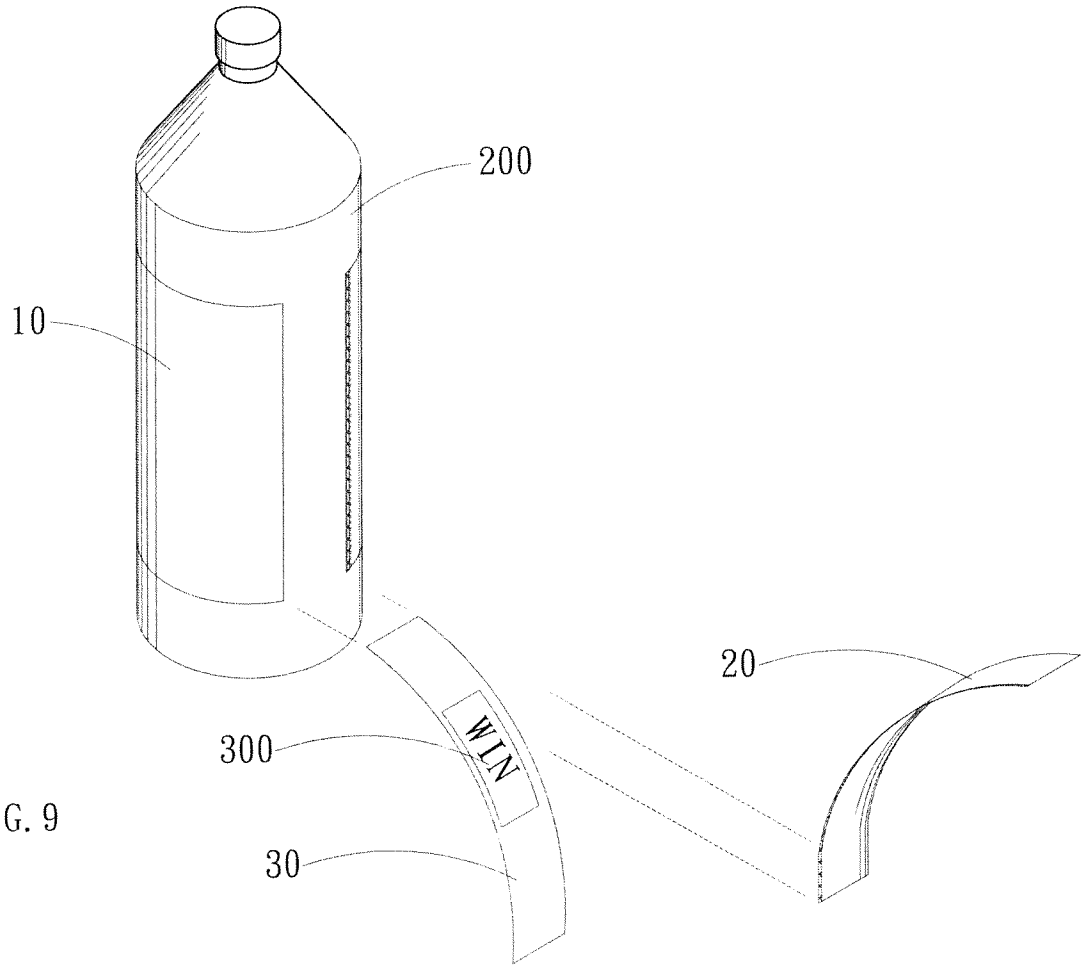
FIG. 9 is a perspective view showing the second tearable strip of the plastic film with concealed tearable strip according to the present invention being completely removed and turned over.

At least one second tearable strip 30 has at least one surface comprising information, patterns, and/or markings regarding prize awarding, bonus points, and/or discount coupon printed thereon. In the present invention, an example is illustrated that the second tearable strip 30 has a rear surface to which a prize awarding sign 300 (see FIG. 9) is attached. The second tearable strip 30 has two sides each forming a third joint section 31 and an internal tear line 32. The third joint section 31 has one side forming at least one tear line 311. The side of the second tearable strip 30 that forms the internal tear line 32 is connected to one of the sides of the film body 10. The connection between the second tearable strip 30 and the film body 10 is not limited to any specific form or way and in the first embodiment of the present invention, an example that the internal tear line 32 is integrally formed with the film body 10 is illustrated.

The third joint section 31 and the internal tear line 32 of the second tearable strip 30 have inner faces respectively coupled to the first joint section 21 and the second joint section 22 of the first tearable strip 20 (as indicated by arrow of FIG. 3) so that the first tearable strip 20 and the second tearable strip 30 are respectively located at outside and inside of the film body 10 (see FIG. 4), whereby the second tearable strip 30 is protected by the first tearable strip 20 and thus concealed at the inside of the film body 10. The information and/or patterns regarding prize awarding, bonus points, and/or discount coupon or the prize awarding sign 300 that are provided on the rear surface of the second tearable strip 30 are thus properly concealed for confidentiality.

The coupling between the first joint section 21 and the second joint section 22 of the first tearable strip 20 and the inside faces of the third joint section 31 and the internal tear line 32 of the second tearable strip 30 is not limited to any specific form. In the present invention, adhesive bonding is taken as an example, but other equivalent structures, such as high frequency or ultrasonic heating, are also considered within the scope of the present invention.

Figure 6:
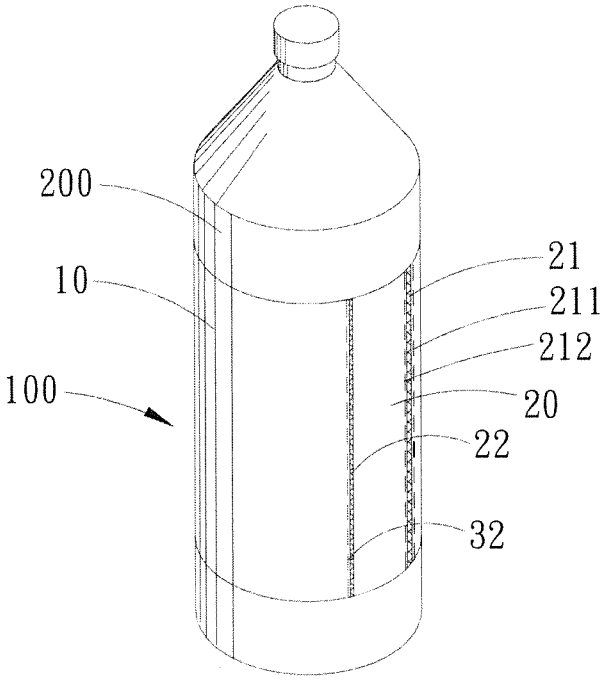
FIG. 6 is a perspective view showing the plastic film with concealed tearable strip according to the present invention wrapping around the container.
Figure 7:
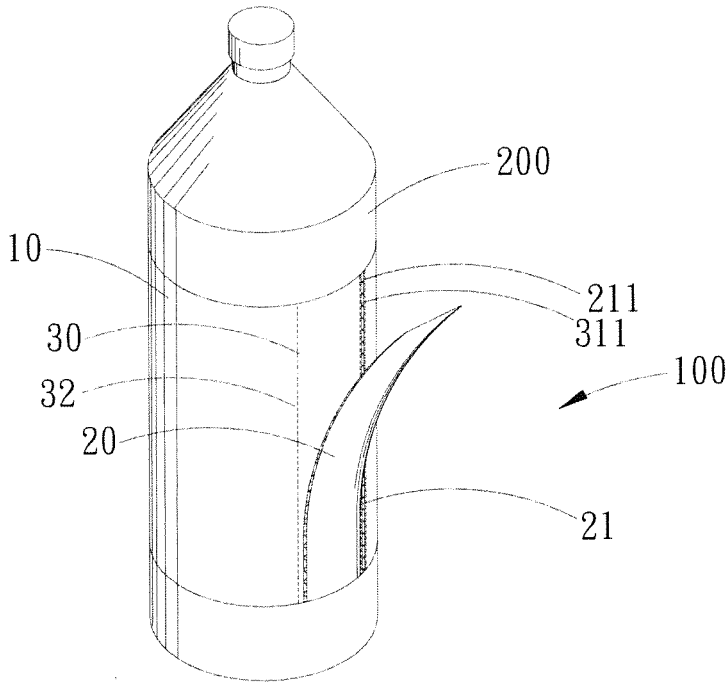
FIG. 7 is a perspective view showing a first tearable strip of the plastic film with concealed tearable strip according to the present invention being torn along a tear line and the flapped over.
Figure 8:
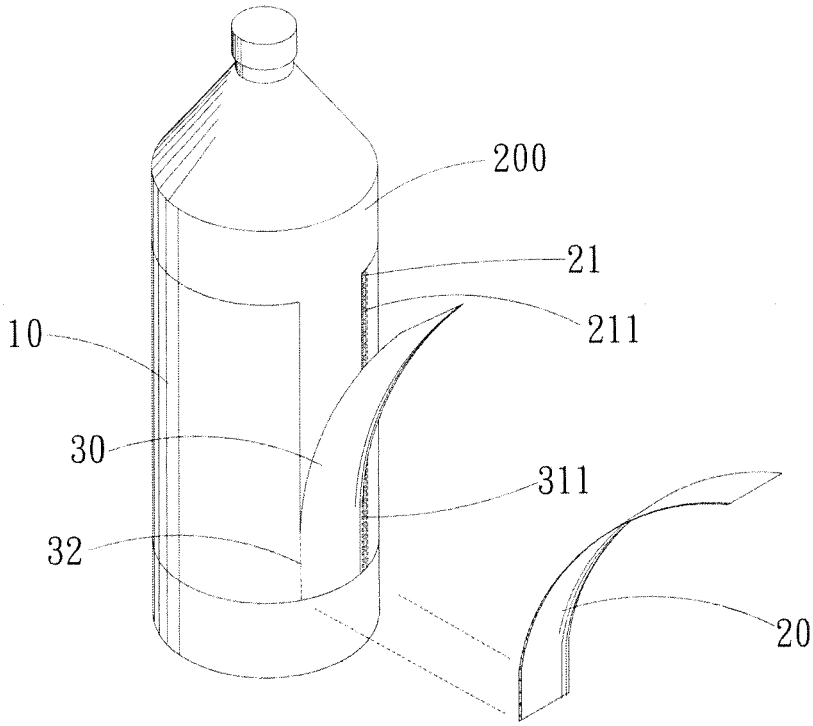
FIG. 8 is a perspective view showing a second tearable strip of the plastic film with concealed tearable strip according to the present invention being torn along a tear line.

Also referring to FIGS. 5-9, a preferred application of the plastic film 100 according to the present invention is illustrated, wherein the plastic film 100 is fit over the exterior of a bottle-like container 200 (see FIG. 5) and is subjected to heat shrinking to fix to and wrap around the exterior of the container 200 (see FIG. 6). To redeem a prize, tear is first made along the tear line 212 on one side of the first joint section 21 of the first tearable strip 20 to tear off one side of the first tearable strip 20 and the first tearable strip 20 is then flapped over (see FIG. 7) to expose the second tearable strip 30. Afterwards, tear is made along the tear line 311 and the internal tear line 32 of the third joint section 31 of the second tearable strip 30 to remove off the second tearable strip 30 (see FIG. 8). The second tearable strip 30, after being completely removed, is turned over (as indicated by arrow of FIG. 9) to reveal the prize awarding sign 300 printed on the rear face of the second tearable strip 30, which can then be presented as a proof for redeeming the prize, bonus points, and/or discount coupon carried by the container 200.

Figure 10:
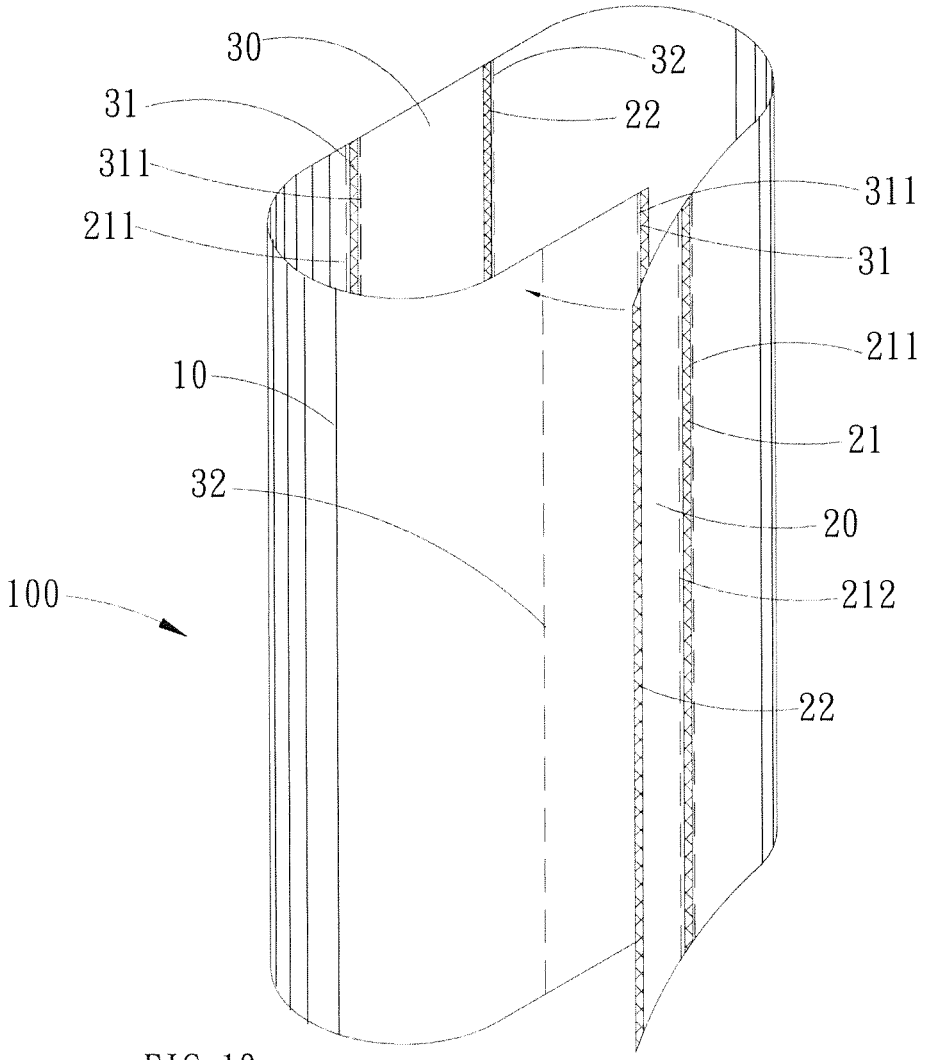
FIG. 10 is a perspective view showing a plastic film with concealed tearable strip according to a second embodiment of the present invention.
Figure 11:
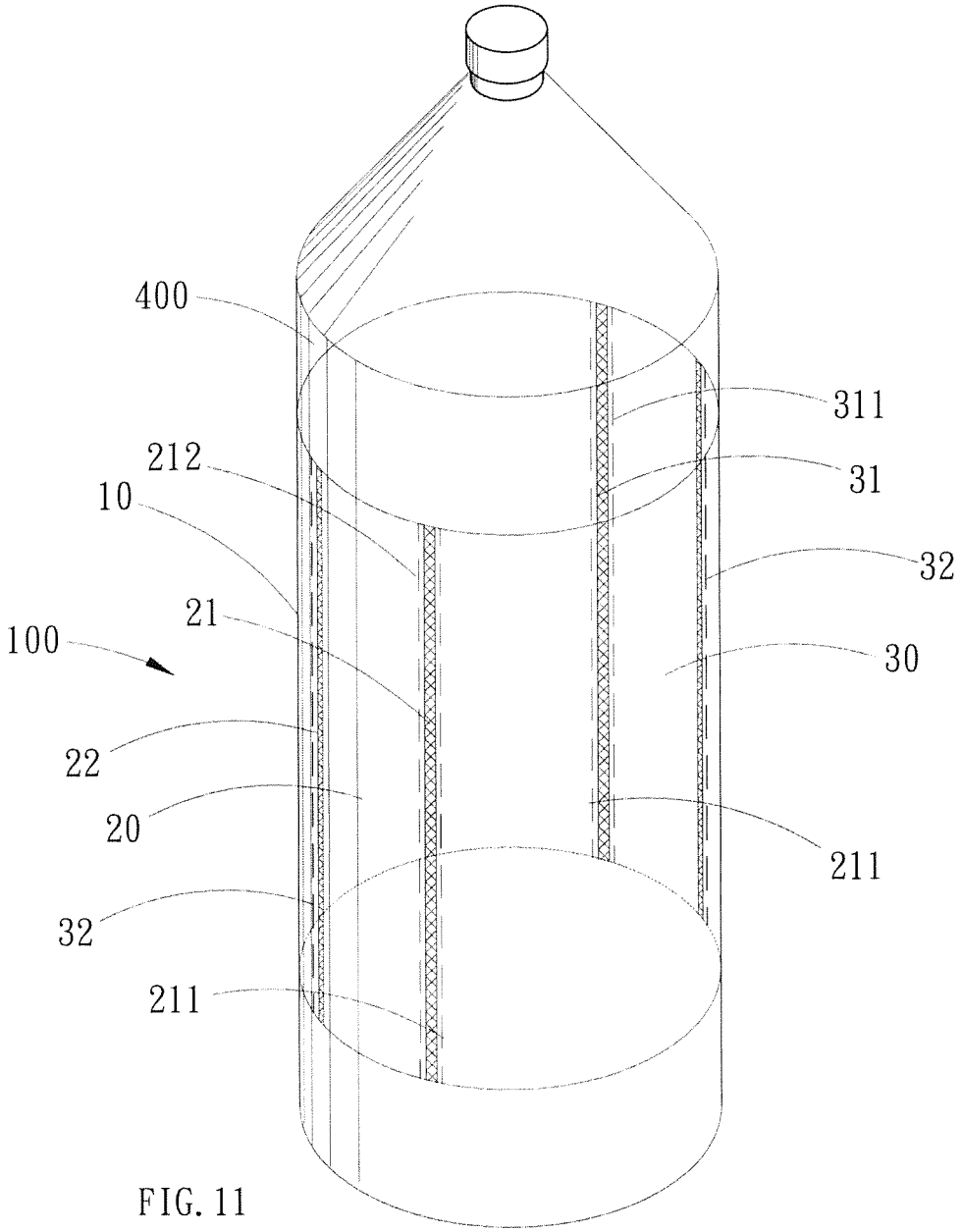
FIG. 11 is a perspective view showing the plastic film with concealed tearable film being fit over an exterior of a container.
Figure 12:
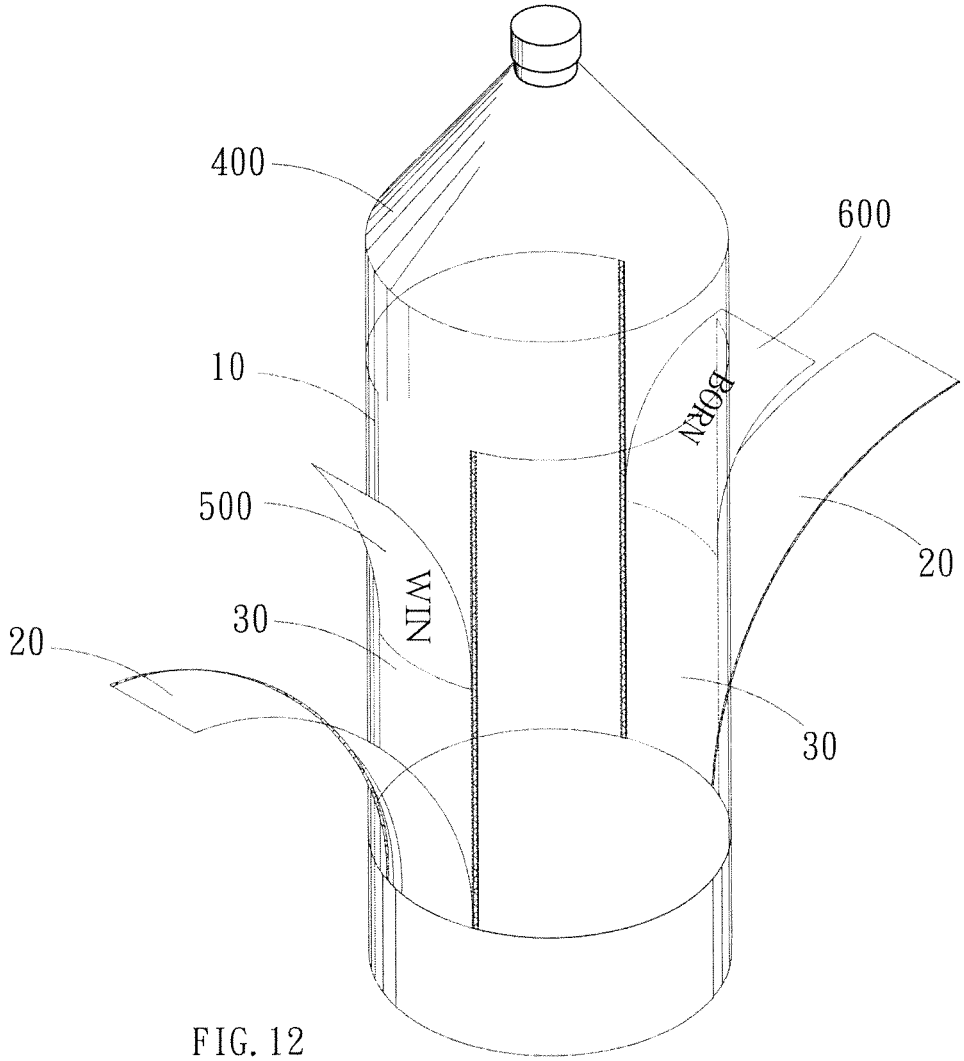
FIG. 12 is a perspective view showing two sets of second tearable strip of the plastic film with concealed tearable strip of FIG. 11 being torn off.

Referring to FIGS. 10-12, a plastic film 100 according to a second embodiment of the present invention is shown, wherein the film body 10 of the plastic film 100 comprises two sets of inside and outside combined structures of first tearable strip 20 and second tearable strip 30 (see FIG. 10). The plastic film 100 can be fit over and heated to shrink on the container 400 (see FIG. 11) to have the two sets of inside and outside combined structures of first tearable strip 20 and second tearable strip 30 respectively located at opposite positions that are separated by 180 degrees. Similar to the operation illustrated in FIGS. 5-9, the first tearable strip 20 of each set is first torn and flapped over to allow the second tearable strip 30 to be removed, whereby the prize awarding signs 500, 600 printed on the rear faces of the second tearable strips 30 of the two sets can be revealed by tearing off the second tearable strips 30 (see FIG. 12). The prize awarding signs 500, 600 of the second tearable strips 30 of the two sets can be proofs for prize awarding, bonus points, and/or discount coupons for different items of products in different activities or can be paired proofs for prize awarding, bonus points, and/or discount coupons for series products of the container 400.

Figure 13:
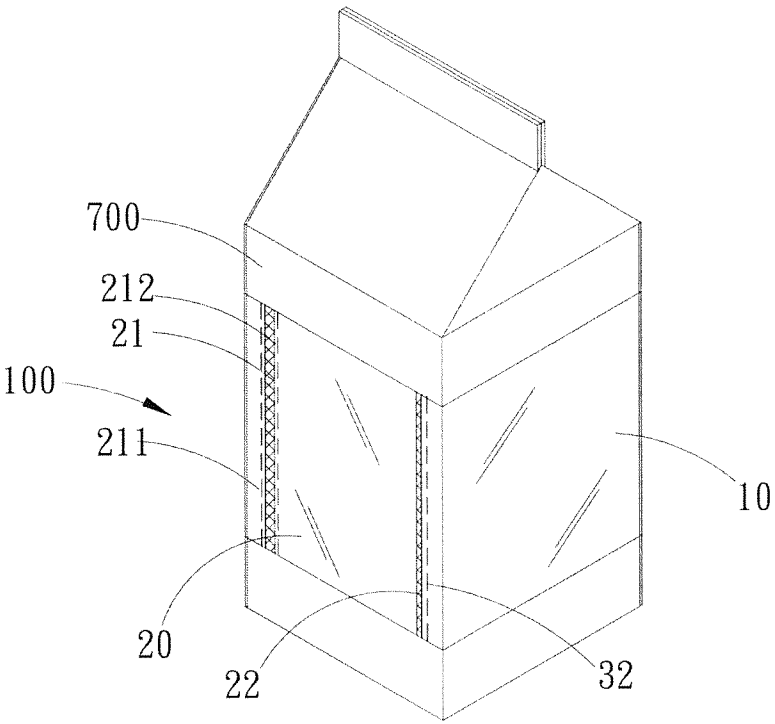
FIG. 13 is a perspective view showing a plastic film with concealed tearable strip according to a third embodiment of the present invention.

Referring to FIG. 13, a plastic film 100 according a third embodiment of the present invention is illustrated, which is applicable to a rectangular container 700. This infers that the plastic film 100 according to the present invention is applicable to packaged production of various forms. Similarly, the first tearable strip 20 is first torn and flapped over and then the concealed second tearable strip 30 is removed to redeem the prize awarding, bonus points, and/or discount coupons provided by the container 700 with the removed second tearable strip 30.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A plastic film with concealed tearable strip for wrapping about a container body, comprising:

a film body;

at least one first tearable strip extending from a first edge of the film body, the first tearable strip defining a first interior portion and a first exterior portion, the first interior and exterior portions respectively forming at least one first joint section and at least one second joint section for attachment to the container body, a first tear line extending between the first edge of the film body and the first interior portion and a second tear line extending between the first interior portion and the first exterior portion; and at least one second tearable strip extending from a second edge of the film body, the second tearable strip defining a second interior portion and a second exterior portion, the second exterior portion forming a third joint section for attachment to the container body, an internal tear line extending between the second interior portion and the second edge of the film body and an external tear line extending between the second interior portion and the second exterior portion, the first tearable strip being configured to substantially overlay the second tearable strip when the plastic film is wrapped about the container body to align the first tear line of the first tearable strip and the external tear line of the second tearable strip.

2. The plastic film with concealed tearable strip as claimed in claim 1, wherein the first tearable strip has an outside surface comprising information, patterns, or markings of product and advertisement printed thereon.

3. The plastic film with concealed tearable strip as claimed in claim 1, wherein the first tear line of the first joint section of the first tearable strip is integrally formed with the film body.

4. The plastic film with concealed tearable strip as claimed in claim 1, wherein the second tearable strip has at least one surface comprising a sign printed thereon for prize awarding, bonus points, and discount coupons.

5. The plastic film with concealed tearable strip as claimed in claim 1, wherein the internal tear line of the second tearable strip is integrally formed with the film body.

6. The plastic film with concealed tearable strip as claimed in claim 1, wherein the first tearable strip allows the second interior portion of the second tearable strip to be exposed by tearing along the second tear line and folding the first exterior portion away from the first edge of the film body, the first interior portion of the first tearable strip forming a residual portion of the first tearable strip remaining attached to the second internal portion of the second tearable strip for removal therewith.

* * * * *